US007364044B2

(12) United States Patent
Hinata

(10) Patent No.: US 7,364,044 B2
(45) Date of Patent: Apr. 29, 2008

(54) SAFETY DEVICE AGAINST OVERTURNING CRANE

(75) Inventor: Shigemoto Hinata, Sakura (JP)

(73) Assignee: Furukawa Co., Ltd., Tokyo (JP)

( * ) Notice: Subject to any disclaimer, the term of this patent is extended or adjusted under 35 U.S.C. 154(b) by 8 days.

(21) Appl. No.: 10/552,787

(22) PCT Filed: Apr. 5, 2004

(86) PCT No.: PCT/JP2004/004910

§ 371 (c)(1),
(2), (4) Date: Oct. 10, 2005

(87) PCT Pub. No.: WO2004/089804

PCT Pub. Date: Oct. 21, 2004

(65) Prior Publication Data

US 2007/0012641 A1 Jan. 18, 2007

(30) Foreign Application Priority Data

Apr. 10, 2003 (JP) ..... 2003-105997

(51) Int. Cl.
*B66C 15/06* (2006.01)

(52) U.S. Cl. ..... 212/277; 212/304; 212/305; 280/765.1

(58) Field of Classification Search ..... 212/277, 212/302–305; 280/764.1, 765.1, 766.1
See application file for complete search history.

(56) References Cited

U.S. PATENT DOCUMENTS 2,855,111 A * 10/1958 McIntyre, Sr. ..... 280/764.1
3,608,756 A * 9/1971 Guinot ..... 414/694
3,713,129 A * 1/1973 Buchholz ..... 340/517
3,824,578 A * 7/1974 Harders ..... 340/685
4,266,627 A * 5/1981 Lauber ..... 180/8.3

(Continued)

FOREIGN PATENT DOCUMENTS

JP 51-11556 1/1976

(Continued)

OTHER PUBLICATIONS

International Preliminary Report on Patentability for International Application No. PCT/JP2004/004910.

(Continued)

*Primary Examiner*—Thomas J. Brahan
(74) *Attorney, Agent, or Firm*—Young Basile

(57) ABSTRACT

The present invention provides a safety device against crane overturning which operates in a crawler crane comprising at least four outriggers in a frame, the safety device comprising a load detector 2 that detects a ground reaction to each of the outriggers, and an alarm output section 4 which calculates sums of detected values for ground reactions to every two adjacent outriggers to find a minimum value of the sums. The alarm output section then compares the minimum value obtained with a preset preliminary reference value and a preset limit reference value and outputs a preliminary alarm signal when the minimum value is smaller than the preliminary reference value or outputs a limit alarm signal when the minimum value is smaller than the limit reference value. This prevents safety from being degraded as a result of a change in the working radius of the crane. Further, calculation processes are simplified.

15 Claims, 14 Drawing Sheets

U.S. PATENT DOCUMENTS

| | | | | |
|---|---|---|---|---|
| 4,765,423 | A * | 8/1988 | Karpa | 177/211 |
| 5,119,949 | A * | 6/1992 | Kishi | 212/277 |
| 5,217,126 | A * | 6/1993 | Hayashi et al. | 212/277 |
| 5,622,235 | A * | 4/1997 | Merritt | 180/9.42 |
| 5,887,735 | A * | 3/1999 | Abel | 212/277 |
| 5,961,145 | A * | 10/1999 | Schillinger et al. | 280/764.1 |
| 6,360,905 | B1 * | 3/2002 | Frommelt et al. | 212/302 |
| 6,735,486 | B2 * | 5/2004 | Hoffelmeyer et al. | 700/80 |
| 7,005,587 | B2 * | 2/2006 | Axakov et al. | 177/164 |
| 7,012,540 | B2 * | 3/2006 | Petzold et al. | 340/679 |
| 2002/0020231 | A1 | 2/2002 | Saitoh et al. | |

FOREIGN PATENT DOCUMENTS

| | | | |
|---|---|---|---|
| JP | 03-025495 | U | 3/1991 |
| JP | 06-018120 | U | 3/1991 |
| JP | 05-046880 | U | 6/1993 |
| JP | 06-063577 | U | 9/1994 |
| JP | 08-073189 | A | 3/1996 |
| JP | 10-072187 | A | 3/1998 |
| JP | 10-291779 | A | 11/1998 |
| JP | 2001-220086 | A | 8/2001 |
| JP | 2002-003172 | A | 1/2002 |
| JP | 2002-104777 | A | 4/2002 |

OTHER PUBLICATIONS

Notification and International Preliminary Report on Patentability dated Oct. 14, 2005.

English Translation of Decision of Rejection for Patent Application No. JP 2003-105,997.

* cited by examiner

SAFETY DEVICE AGAINST OVERTURNING CRANE

TECHNICAL FIELD

The present invention relates to a safety device against crane overturning which device prevents a crane from overturning during operations.

BACKGROUND ART

As shown in FIG. 13, a conventional crawler crane 1 comprises a traveling member located below a frame 11 and traveling using a crawler, and lateral pairs of (a total of four) outriggers A, B, C and D provided at a front and rear ends, respectively, of the frame 11 to ensure safety during operations (see JP2002-3172A).

Examples of a safety device against crane overturning include a moment limiter device using a microcomputer and a safety device against overturning comprising a flexing structure interposed between an outrigger main body and a ground panel, detecting means for detecting the amount of flexure, and control means for outputting an alarm or shutting off a hydraulic circuit when the amount of flexure exceeds a predetermined set value (see JP6-63577U).

A safety device against overturning implements predetermined overturning preventing means by using a load detector to detect the ground reaction to each outrigger, finding the ratio of the smallest of the sums of the ground reactions to every two longitudinally or laterally adjacent outriggers to the sum of the ground reactions to all the outriggers, and comparing the value of the ratio (safety) with a predetermined safety reference value (see JP10-72187A).

This safety device against overturning prevents overturning by executing the process described below.

The ground reactions Pa, Pb, Pc and Pd to the four outriggers A, B, C, and D are detected.

The sums of the ground reactions to every two longitudinally or laterally adjacent outriggers are calculated to find the minimum value Smin.

$$S1=Pa+Pb$$

$$S2=Pb+Pc$$

$$S3=Pc+Pd$$

$$S4=Pd+Pa$$

(3) The sum of the ground reactions to all the outriggers is found.

$$\Sigma Pi=Pa+Pb+Pc+Pd$$

(4) Safety is determined.

$$R=Smin/\Sigma Pi$$

(5) The value for safety R is compared with a predetermined safety reference value R0. If R≧R0, the device determines that the crane is safe. If R<R0, the device determines that the crane may overturn to actuate an alarm lamp.

However, this safety device against overturning poses the problems described below.

In connection with the overturning performance of the crane, the crane has a fixed overturning moment. Accordingly, a rated load Wr regulating the upper limit of a lifting load W decreases with increasing working radius r.

The sum ΣPi of the ground reactions to all the outriggers is equal to the sum of the lifting load W and the weight of the machine body (fixed). Accordingly, an increase in working radius r and a decrease in rated load Wr reduce the sum ΣPi of the ground reactions to all the outriggers.

When the safety device against overturning outputs an alarm, the relationship between the safety R and the safety reference value R0 is R<R0. Since R=Smin/ΣPi, a decrease in the value of the sum ΣPi of the ground reactions reduces the minimum value Smin of sums of the ground reactions to every two adjacent outriggers at which value the alarm is output.

That is, an increase in working radius r reduces the minimum value Smin of sums of the ground reactions to every two adjacent outriggers at which value the alarm is output. This lowers the reference value for the reaction at which value an alarm for crane overturning is output. The reference value approaches zero.

When the minimum value Smin of sums of the ground reactions to every two adjacent outriggers at which value the alarm is output approaches zero, this means a short time interval between the output of the alarm and overturning. That is, a slight overload may cause the outriggers to float. Consequently, if the crane is violently operated with a large working radius r, inertia acting on a cargo or a boom may lower the value for safety R below the safety reference value R0. Then, the outriggers may float immediately after the alarm has been output. This may cause the crane to overturn.

Further, each of the outriggers A, B, C, and D of the crawler crane 1 comprises an attaching member 13 supported by the frame 11 using a rotatively moving shaft 12 so that the attaching member 13 is rotatively movable in a horizontal direction, a base end arm 15 supported by the attaching member 13 using a rising and lying shaft 14 so that the base end arm 15 can be freely raised and laid, an intermediate arm 17 supported by the base end arm 15 using a rising and lying shaft 16 so that the intermediate arm 17 can be freely raised and laid, a leading end arm 18 slidably fitted into the intermediate arm 17, a ground contact portion 19 pivotably connected to a leading end of the leading end arm 18, and an outrigger cylinder 20 provided between the attaching member 13 and the base end arm 15 to raise and lay the base end arm 15, as shown in FIG. 14.

With the safety device against overturning of the crawler crane 1, the load detector is commonly provided between the leading end arm 18 and the ground contact portion 19.

However, in this case, the electric wiring between the load detector and the calculating portion of the safety device against overturning must be laid through the sliding portion between the leading end arm 18 and the intermediate arm 17 and the rotative moving portions between the intermediate arm 17 and the base end arm 15, between the base end arm 15 and the attaching member 13, and between the attaching member 13 and the frame 11. Consequently, the electric wiring is cumbersome and is likely to be broken.

To avoid this problem, the load detector 2 may be provided at a base end of the outrigger cylinder 20 or a base end of the base end arm 15.

However, if the load detector 2 is installed at such a position, the force exerted on the load detector 2 is much stronger than the ground reaction acting on the ground contact portion 19.

For example, if the load detector 2 is provided at the base end of the outrigger cylinder 20, if the rising and lying shaft 14 at the base end of the base end arm 15 is defined as the center of a moment attributed to the ground reaction, the product of the ground reaction P acting on the ground contact portion 19 and the overhang distance La of the outrigger is equal to the product of the force F exerted on the load detector 2 and the distance Lb between the rising and lying shaft 14 and an attaching pin 21 of the outrigger cylinder 20. That is, the following equation can be given.

$$P \times La = F \times Lb$$

Accordingly, the ratio of the force F exerted on the load detector 2 to the ground reaction P is:

$$F/P = La/Lb.$$

Therefore, if the overhang distance La of the outrigger is 1.5 m and the distance Lb between the rising and lying shaft 14 and the attaching pin 21 of the outrigger cylinder 20 is 0.3 m, the force F exerted on the load detector 2 is five times as strong as the ground reaction P.

If the load detector 2 is composed of, for example, a load cell (see JP2001-220086A) having a strain gauge on a coil spring, the force F exerted on the load detector 2 increases, resulting in the need for a larger coil spring. This requires an increase in the size of the load detector 2.

However, the crawler crane 1 must be made compact to prevent an increase in the width of the crawler so as to meet the requirements for transportation using a transport vehicle. Thus, the size of the outriggers A, B, C, and D must be minimized. This limits the outside dimensions of the load detector 2, thus precluding the free selection of an installation position.

On the other hand, if a boom 5 is located on any of the outriggers A, B, C, and D, the crawler crane 1 is unlikely to overturn. That is, in this state, the crawler crane 1 does not overturn in spite of an excessive lifting load W. As a result, the boom 5 or the like may be overloaded and damaged.

DISCLOSURE OF THE INVENTION

It is an object of the present invention to provide a safety device against crane overturning which solves the above problems and which can prevent safety from being degraded as a result of a change in working radius, the safety device allowing the outside dimensions of a load detector to be reduced to enable a heavy load to be detected and making it possible to prevent electric wiring from being broken as a result of provision of the load detector between a leading end arm and ground contact portion of an outrigger.

It is also an object of the present invention to provide a safety device against crane overturning which stops the operation of a crawler crane or outputs an alarm before a lifting load becomes excessive and equal to a crane strength limit load that may damage the crawler crane, thus preventing the crawler crane from being damaged and improving the safety of crane operations.

To accomplish these objects, the present invention provides a safety device against crane overturning which operates in a crawler crane comprising at least four outriggers in a frame, the safety device comprising a load detector that detects a ground reaction to each of the outriggers, and an alarm output section which calculates sums of detected values for ground reactions to every two adjacent outriggers to find a minimum value of the sums, comparing the minimum value obtained with a preset preliminary reference value and a preset limit reference value, and outputting a preliminary alarm signal when the minimum value is smaller than the preliminary reference value or outputting a limit alarm signal when the minimum value is smaller than the limit reference value.

In the safety device against crane overturning, the alarm output section calculates the sums of the detected values for the ground reactions to every two adjacent outriggers on the basis of the values detected by the load detector to find the minimum value of the sums. The alarm output section compares the minimum value obtained with the preset preliminary reference value and the preset limit reference value. The alarm output section then outputs the preliminary alarm signal when the minimum value is smaller than the preliminary reference value or outputs the limit alarm signal when the minimum value is smaller than the limit reference value.

Accordingly, an increase in working radius does not reduce the minimum value of sums of the ground reactions to every two adjacent outriggers at which value the alarm is output. This makes it possible to prevent safety from being degraded as a result of a change in working radius.

Further, it is unnecessary to calculate the sum of the ground reactions to all the outriggers or the ratio of the minimum value of sums of the ground reactions to every two adjacent outriggers to the sum of the ground reactions to all the outriggers. This simplifies calculating processes.

The load detector is provided with a coned disk spring which serves as an elastic member supporting a load. This serves to reduce the size of the load detector to enable a heavy load to be detected. Consequently, no problem occurs even if the force exerted on the load detector becomes stronger than the ground reaction acting on the ground contact portion. This enables the installation position to be freely selected.

The load detector is provided at a base end of an outrigger cylinder or at a base end of a base end arm. This prevents electric wiring from being broken as a result of provision of the load detecting device at a leading end of a boom.

The safety device comprises setting switching means for enabling a preliminary reference value and a limit reference value to be switched and set in accordance with an overhang distance of each outrigger. This enables an appropriate alarm to be output even if the crane is used with the outriggers set for a different overhand distance.

The safety device comprises operation switching means for switching the safety device between an inoperative mode and an operative mode depending on whether the crawler crane is in a traveling mode or in a crane mode. Consequently, the safety device against crane overturning can be made operative when the crawler crane is in the crane mode and can be made inoperative when the crawler crane is in the traveling mode in which the safety device need not be actuated.

Moreover, the safety device against crane overturning comprises a damage preventing device including a boom length detector that detects the length of a boom, a boom angle detector that detects the angle of the boom, a load detector that detects a lifting load, and a calculation control section which determines a limit load used to prevent damage and corresponding to a working radius, on the basis of values detected by the boom length detector and boom angle detector, the calculation control section then comparing the limit load obtained with a value detected by the load detector, and outputting a damage prevention signal when the value detected by the load detector reaches the value for the limit load. Then, the safety device stops the operation of the crawler crane or outputs an alarm to call the operator's attention before the lifting load becomes excessive and equal to the crane strength limit load that may damage the crawler crane. This makes it possible to prevent the crawler crane from being damaged.

BEST MODE FOR CARRYING OUT THE INVENTION

Figure 1:
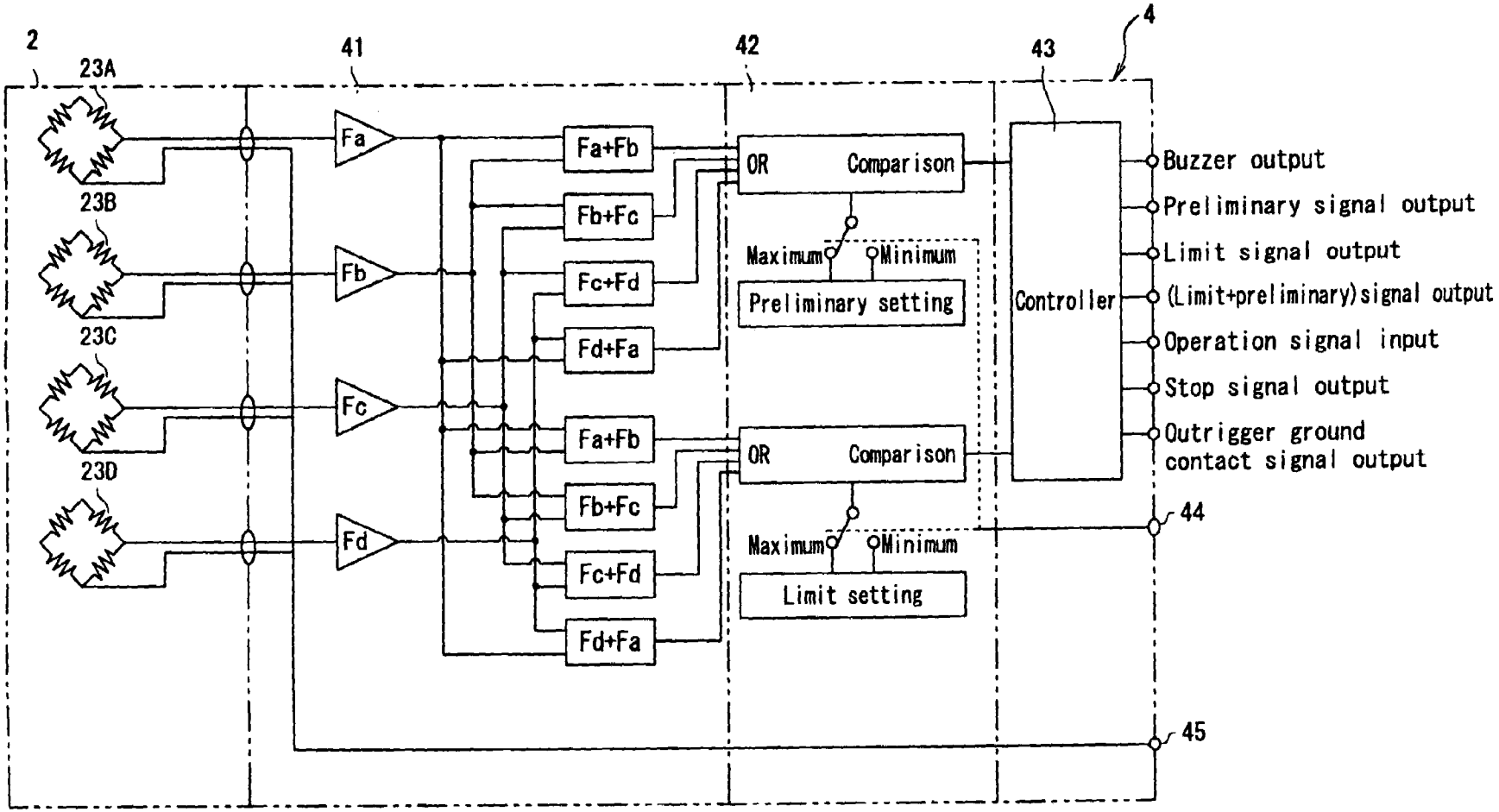
FIG. 1 is a diagram showing the configuration of a safety device against crane overturning in accordance with an embodiment of the present invention.

FIG. 1 is a diagram showing the configuration of a safety device against crane overturning in accordance with an embodiment of the present invention.

Figure 2:
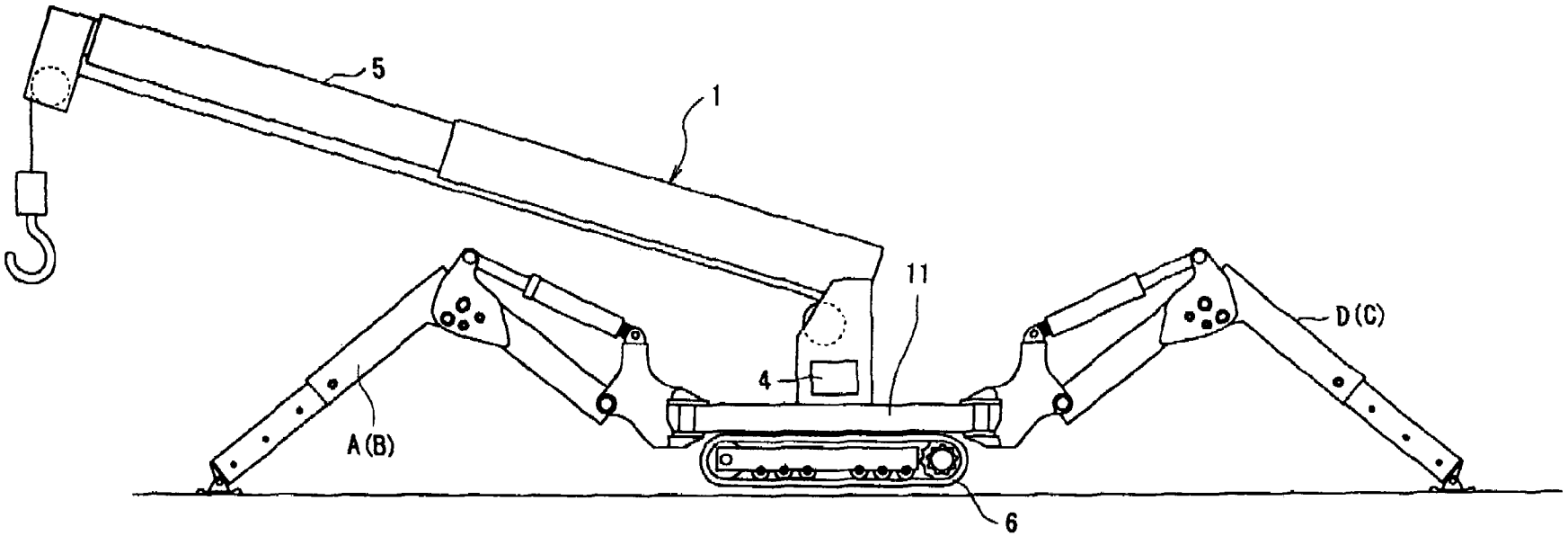
FIG. 2 is a side view showing a crawler crane during operations.

FIG. 2 is a side view showing a crawler crane during operations.

Figure 3:
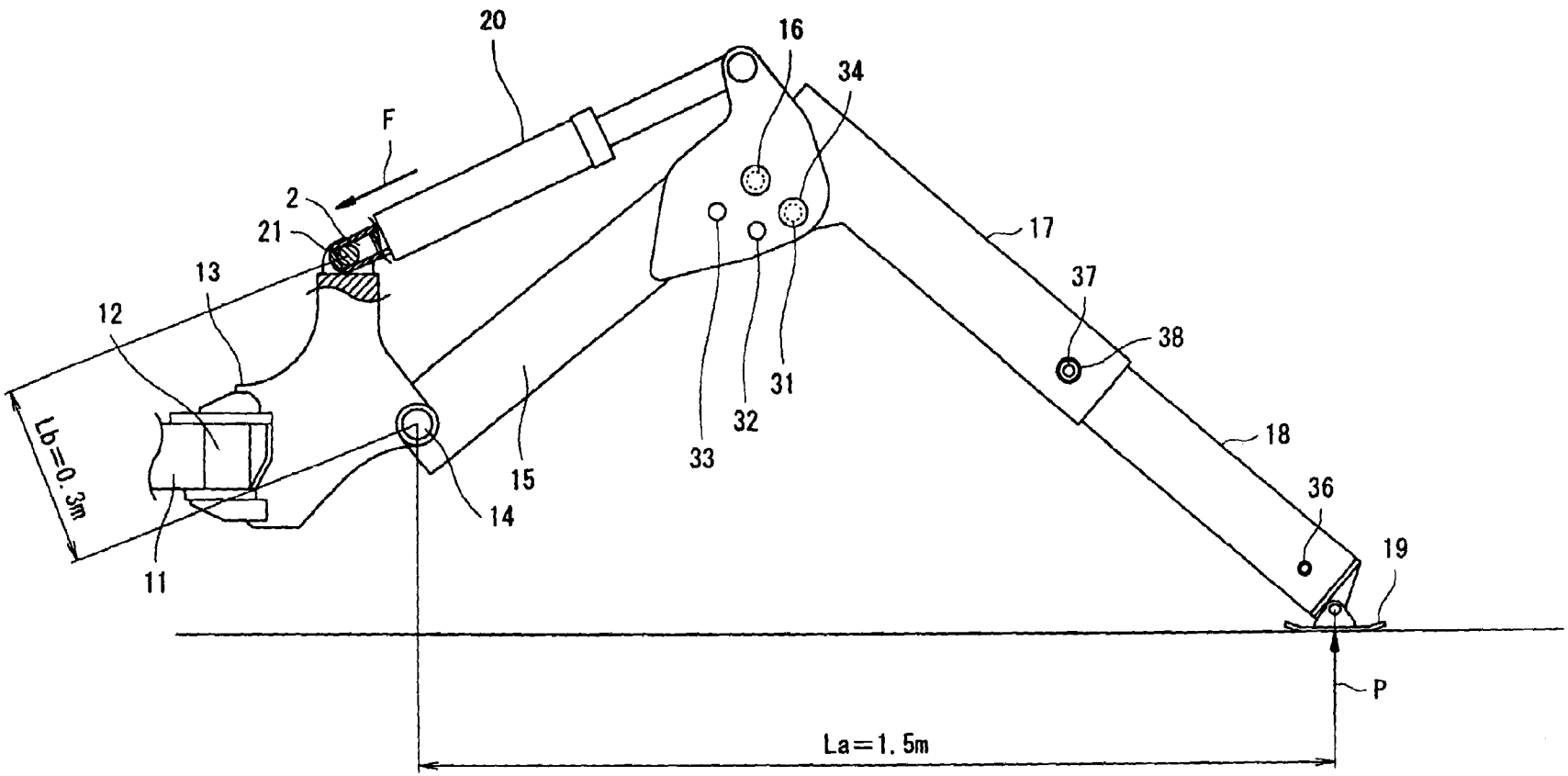
FIG. 3 is a side view showing an outrigger in its maximum overhanging state.

FIG. 3 is a side view showing an outrigger in its maximum overhanging state.

Figure 4:
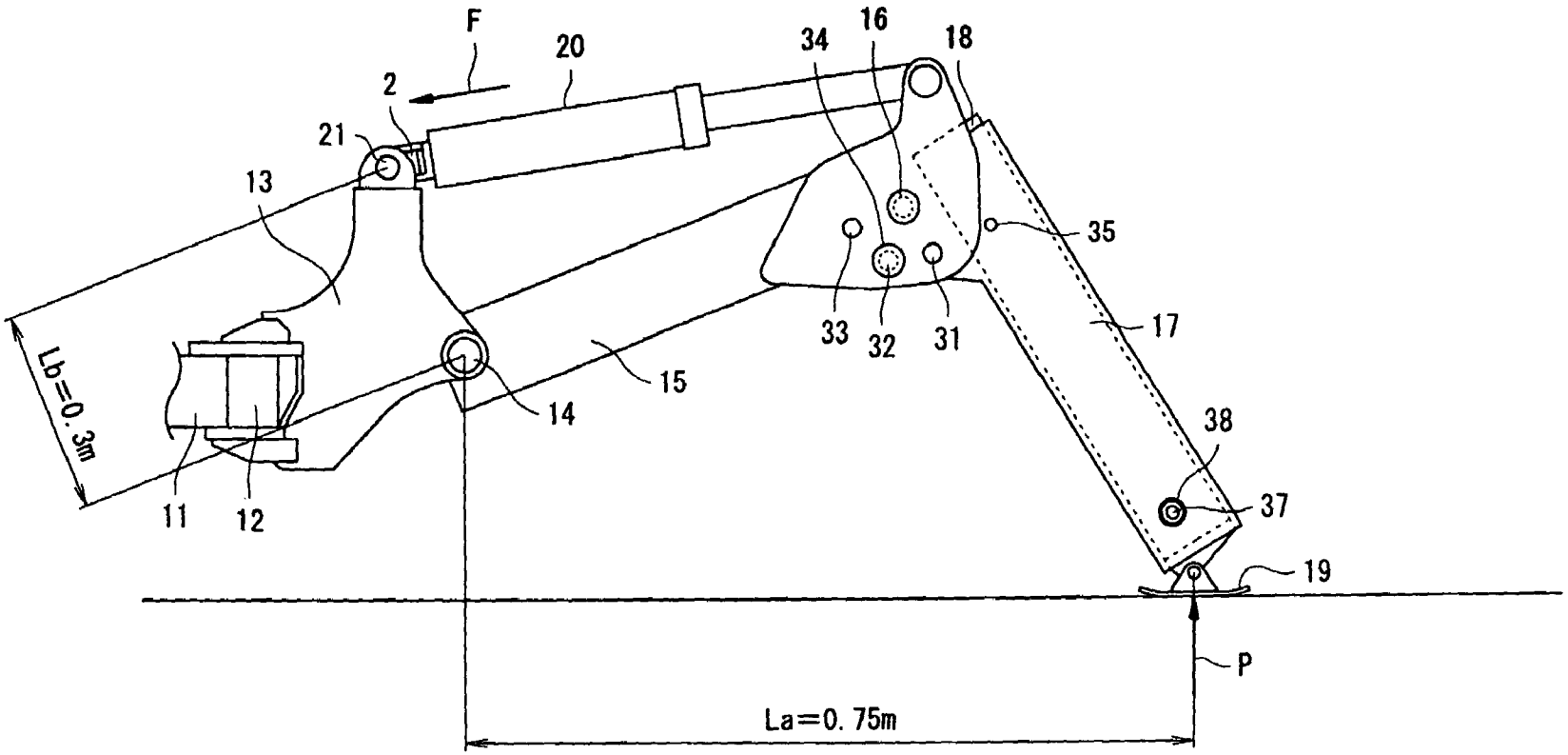
FIG. 4 is a side view showing the outrigger in its minimum overhanging state.

FIG. 4 is a side view showing the outrigger in its minimum overhanging state.

Figure 5:
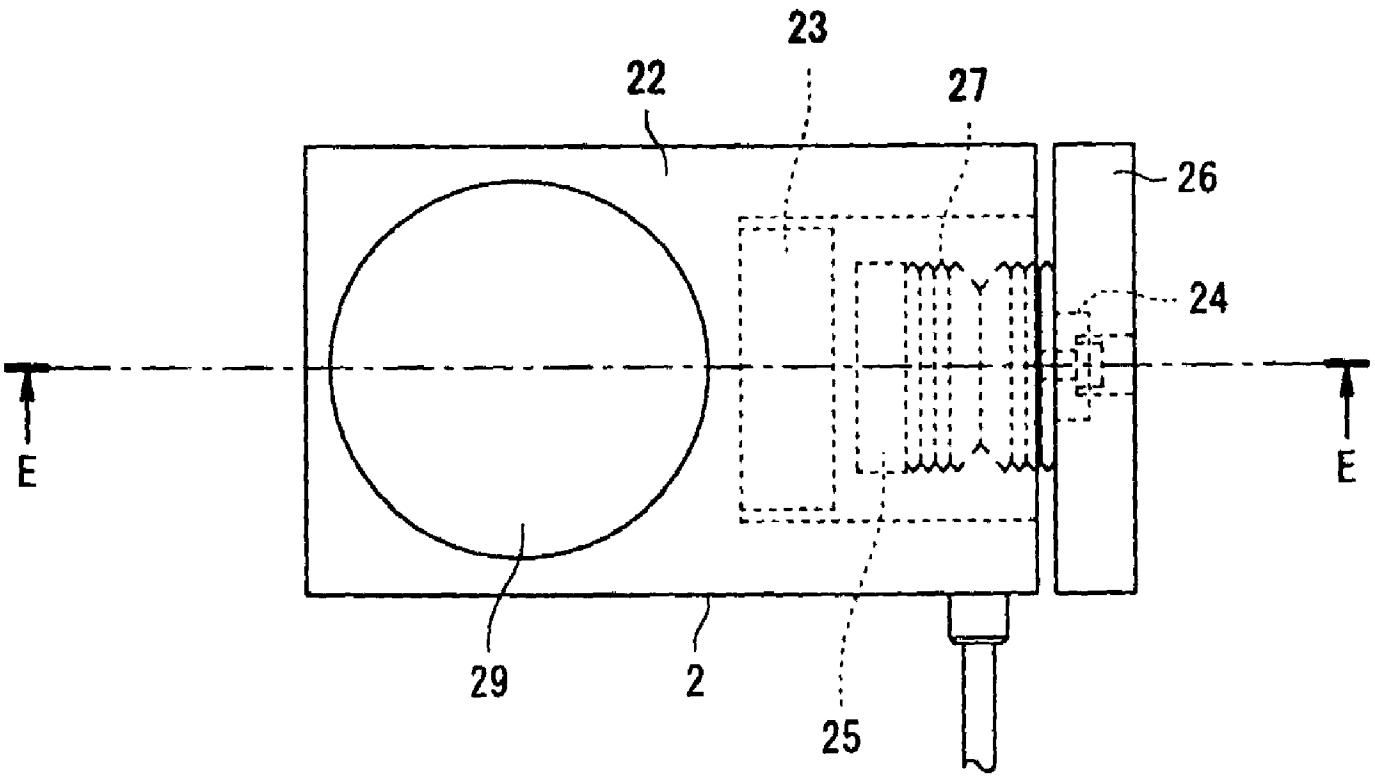
FIG. 5 is a side view of a load detector.

FIG. 5 is a side view of a load detector.

Figure 6:
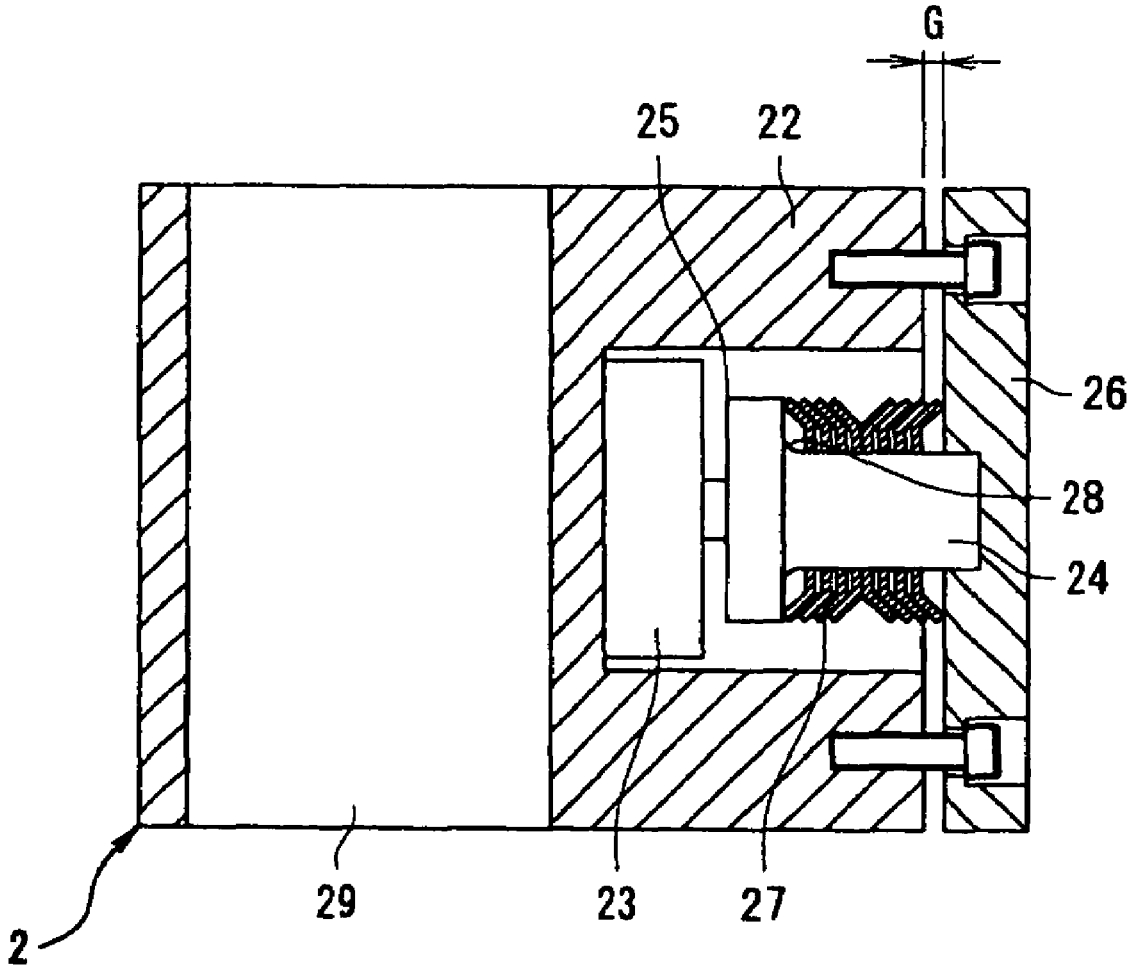
FIG. 6 is a sectional view taken along line E-E in FIG. 5.

FIG. 6 is a sectional view taken along line E-E in FIG. 5.

Figure 7:
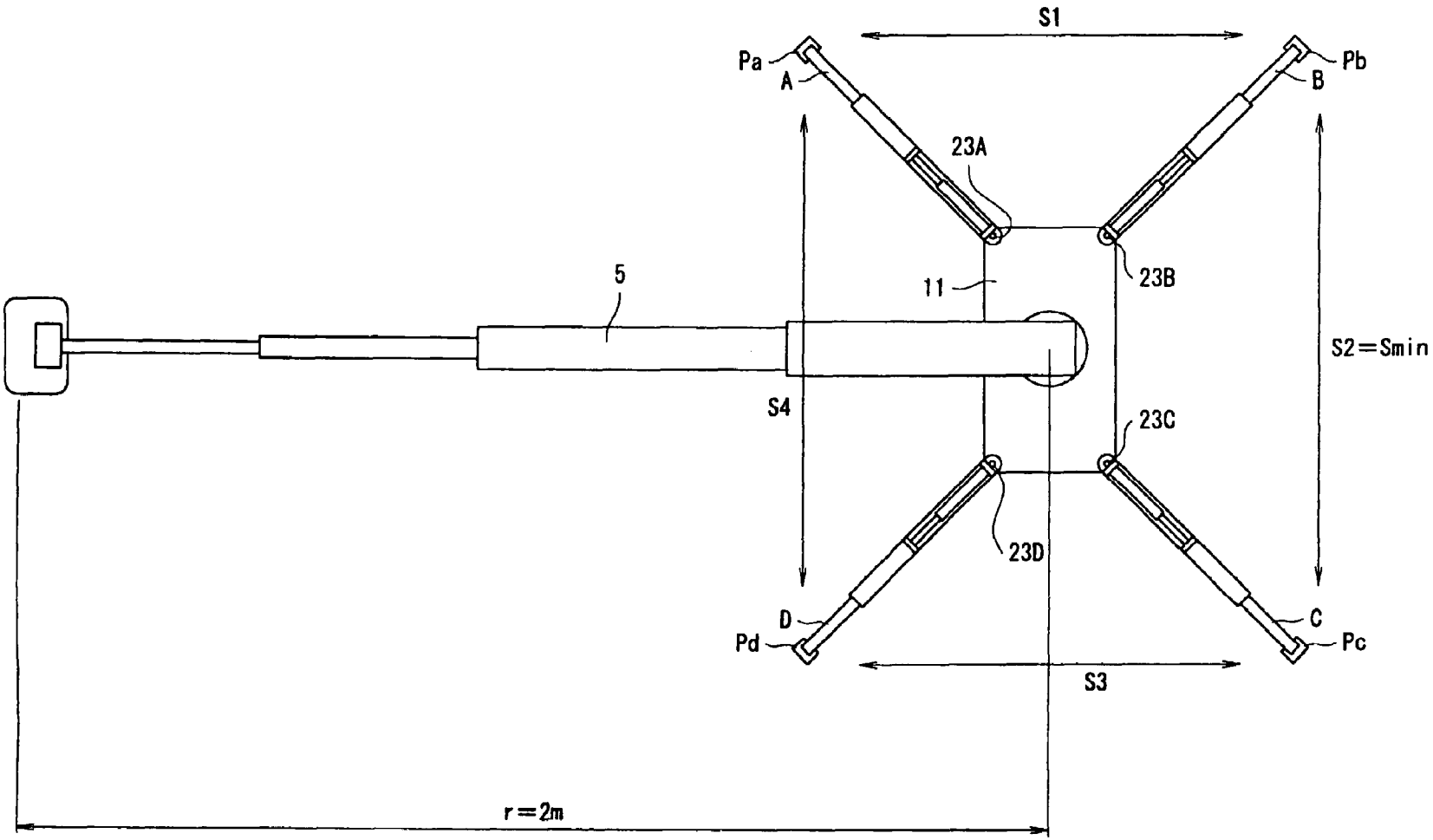
FIG. 7 is a diagram illustrating an operation of the safety device against overturning.
Figure 8:
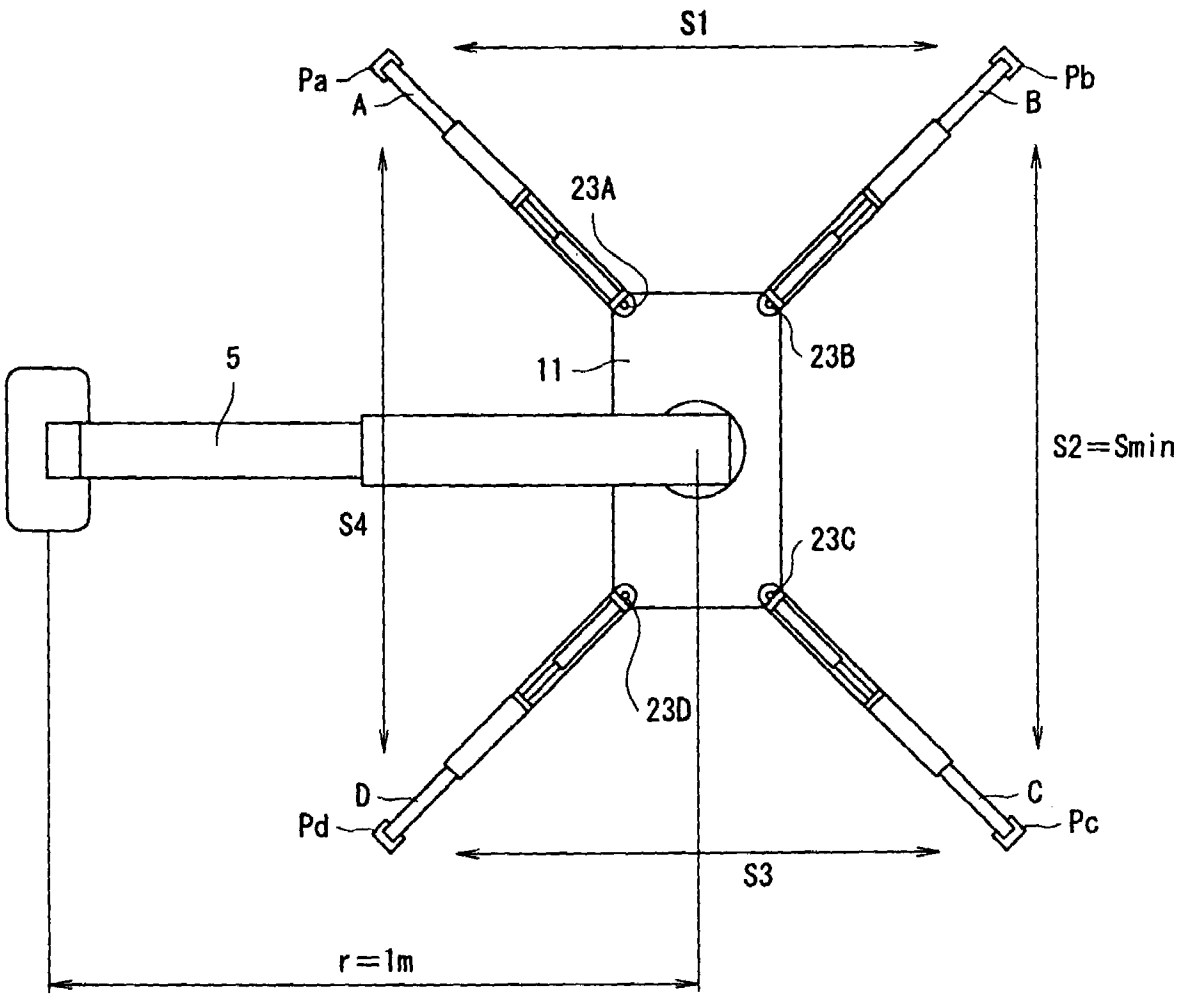
FIG. 8 is a diagram illustrating an operation of the safety device against overturning.

FIGS. 7 and 8 are diagrams illustrating operations of the safety device against overturning.

As shown in FIG. 2, a crawler crane 1 comprises an alarm output section 4, a boom 5 that can be turned, raised and laid, and expanded and contracted, and a traveling member 6 that travels using a crawler; the alarm output section 4 and the boom 5 are provided on a frame 11, and the traveling member 6 is provided under the frame 11. To allow crane operations to be safely performed, a lateral pair of outriggers A and B is provided at a front end of the frame 11, while a lateral pair of outriggers C and D is provided at a rear end of the frame 11; the frame 11 has a total of four outriggers.

As shown in FIG. 3, each of the outriggers A, B, C, and D of the crawler crane 1 comprises an attaching member 13 supported by the frame 11 using a rotatively moving shaft 12 so that the attaching member 13 is rotatively movable in a horizontal direction, a base end arm 15 supported by the attaching member 13 using a rising and lying shaft 14 so that the base end arm 15 can be raised and laid, an intermediate arm 17 supported by the base end arm 15 using a rising and lying shaft 16 so that the intermediate arm 17 can be raised and laid, a leading end arm 18 slidably fitted into the intermediate arm 17, a ground contact portion 19 pivotably connected to a leading end of the leading arm 18, and an outrigger cylinder 20 provided between the attaching member 13 and the base end arm 15 to raise and lay the base end arm 15.

A leading end of the base end arm 15 is provided with a maximum overhang fixing hole 31 used to fix the intermediate arm 17 so as to maximize the overhang distance La of each outrigger, a minimum overhang fixing hole 32 used to fix the intermediate arm 17 so as to minimize the overhang distance La of each outrigger, and a storage fixing hole 33 used to fix the intermediate arm 17 in a storage position. The intermediate arm 17 can be fixed to the base end arm 15 at a varying angle by aligning an angle fixing hole (not shown) in a base end of the intermediate arm 17 with the maximum overhang fixing hole 31, minimum overhang fixing hole 32, or storage fixing hole 33 and inserting a fixing pin 34 into the aligned holes.

Further, as shown in FIG. 4, a maximum expansion and contraction hole 35 is formed at a base end of the leading end arm 18. A minimum expansion and contraction hole 36 is formed at a leading end of the leading end arm 18. The intermediate arm 17 and the leading end arm 18 can be fixed together with the total length varied so as to maximize or minimize the overhang distance La of each outrigger by aligning the maximum expansion and contraction hole 35 or minimum expansion and contraction hole 36 with an expansion and contraction fixing hole 37 at a leading end of the intermediate arm 17 and then inserting a fixing pin 38 into the aligned holes.

A load detector 2 is attached to a base end of an outrigger cylinder 20 of each of the outriggers A, B, C, and D using an attaching pin 21.

As shown in FIGS. 5 and 6 the load detector 2 comprises a load cell 23 in an upper cell case 22 having a pin hole 29 through which the attaching pin 21 is inserted. A plurality of coned disk springs 27 are provided between a spring presser 25 of a shaft 24 and a lower cell case 26. The coned disk springs 27 serve as elastic members. The elastic force of the coned disk springs 27 holds the upper cell case 22 and the lower cell case 26 so as to form a gap G between the cell cases.

The plurality of coned disk springs 27 are laid on top of one another so that half of the coned disk springs face in a direction opposite to that in which the remaining coned disk springs face. The shaft 24 is inserted through holes in the coned disk springs 27. The spring presser 25 is machined so as to be rounded, that is, the spring presser 25 has a rounded portion 28. Accordingly, the coned disk springs 27 are arranged so that their outer edges contact the spring presser 25, thus preventing the inner edges of the coned disk springs 27 from interfering with the rounded portion 28.

The shaft 24 must not rust and must be hard enough to receive loads. Accordingly, a material for the shaft 24 is stainless steel.

When a load is imposed on the load detector 2, the coned disk springs 27 are flexed to cause the load cell 23 to output a load detection signal. If the load exceeds a set load, the upper cell case 22 is joined to the lower cell case 26 to protect the load cell 23 from overload.

Further, it is possible to deal with a change in the range of loads measured by the load cell 23 by varying the number of coned disk springs 27 stacked.

As shown in FIG. 1, The alarm output section 4 comprises adding means 41, comparing means 42, and a controller 43.

The process described below is executed when the crawler crane 1 performs crane operations.

When a working radius r is 2 m as shown in FIG. 7, if the maximum lifting load is 4,900 N, an overturning moment is 9,800 Nm.

For the comparing means 42, a preliminary reference value Fn and a limit reference value Fu are set at 1,800 N and 5,000 N, respectively, for a maximum outrigger overhang state. The preliminary reference value Fn and the limit reference value Fu are set at 55,000 N and 20,000 N, respectively, for a minimum outrigger overhang state.

For each of the preliminary reference value Fn and the limit reference value Fu, a set value is switched using a maximum/minimum overhang switch 44 depending on whether the outriggers A, B, C, and D are in their maximum overhang state or in their minimum overhang state.

When the crawler crane 1 is switched from a traveling mode to a crane mode, a power supply 45 for the safety device against overturning is automatically turned on.

To use the outriggers A, B, C, and D in their maximum overhang state, an operator need not operate the maximum/minimum overhang switch 44. This is because the set values for the maximum outrigger overhang state are selected by default when the device is powered on.

Each of the outriggers A, B, C, and D is rotatively moved horizontally in a corresponding overhang direction from a storage position on the frame 111 as shown in FIG. 7. The fixing pin 34 is removed from the storage fixing hole 33. The intermediate arm 17 is lifted. The angle fixing hole is aligned with the maximum overhang fixing hole 31. The fixing pin 34 is then inserted through the aligned holes. Moreover, the fixing pin 38 is removed from the expansion and contraction fixing hole 37. The leading end arm is pulled out. The maximum expansion and contraction hole 35 is aligned with the expansion and contraction fixing hole 37. The fixing pin 38 is then inserted through the aligned holes for fixation. The outrigger cylinder 20 is extended to contact the ground contact portion 19 with the ground. The traveling member 6 is thus allowed to float to complete installation as shown in FIG. 2.

Load cells 23A, 23B, 23C, and 23D in the respective load detectors 2 detect ground reactions Pa, Pb, Pc, and Pd to the outriggers A, B, C, and D as load values Fa, Fb, Fc, and Fd, respectively; the load detector 2 is provided at the base end of the outrigger cylinder 20 of each of the outriggers A, B, C, and D. The load values Fa, Fb, Fc, and Fd are then sent to the alarm output section 4.

As shown in FIG. 3, the load detector 2 is provided at the base end of the outrigger cylinder 20. If the rising and lying shaft 14 of the base end of the base end arm 15 is defined as the center of a moment attributed to the ground reaction, the product of the ground reaction P acting on the ground contact portion 19 and the overhang distance La of the outrigger is equal to the product of the force F exerted on the load detector 2 and the distance Lb between the rising and lying shaft 14 and the attaching pin 21 of the outrigger cylinder 20. That is, since:

$$P \times La = F \times Lb,$$

the ratio of the force F acting on the load detector 2 to the ground reaction P is:

$$F/P = La/Lb.$$

Therefore, if the overhang distance La of the outrigger is 1.5 m and the distance Lb between the rising and lying shaft 14 and the attaching pin 21 of the outrigger cylinder 20 is 0.3 in, the detected value F of the load detector 2 is five times as strong as the actual ground reaction P.

The adding means 41 of the alarm output section 4 calculates the sums of values detected by the load cells 23 of every two longitudinally or laterally adjacent outriggers.

$$S1 = Fa + Fb$$

$$S2 = Fb + Fc$$

$$S3 = Fc + Fd$$

$$S4 = Fd + Fa$$

The comparing means 42 compares the sums S1, S2, S3, and S4 of the detected values with one another to find the minimum value Smin.

In FIG. 7, the boom 5 is located between the outriggers A and D. Accordingly, the sum S2 corresponds to the minimum value Smin.

Then, the minimum value Smin is compared with the preset preliminary reference value Fn. If the minimum value Smin is smaller than the preliminary reference value Fn=18,000 N, the controller 43 outputs a preliminary alarm signal.

In this case, the ground reaction Pn acting on the ground contact portion 19 is 3,600 N, one-fifths of the preliminary reference value Fn=18,000 N.

Further, when the minimum value Smin is smaller than the preset limit reference value Fu=5,000 N, the controller 43 outputs a limit alarm signal. The controller 43 also outputs a stop signal to actuate an unload valve (not shown) in the crawler crane 1 to stop the crawler crane 1.

On this occasion, the ground reaction Pn acting on the ground contact portion 19 is 1,000 N, one-fifths of the limit reference value Fu=5,000 N.

When the working radius r is 1 m as shown in FIG. 8, the maximum lifting load is 9,800 N.

To use the outriggers A, B, C, and D in their minimum overhang state, the operator operates the maximum/minimum overhang switch 44 to switch to the set values for the minimum outrigger overhang state. This is because the set values for the maximum outrigger overhang state are selected by default when the device is powered on.

Each of the outriggers A, B, C, and D is rotatively moved horizontally in a corresponding overhang direction from a storage position on the frame 11. The fixing pin 34 is removed from the storage fixing hole 33. The intermediate arm 17 is lifted. The angle fixing hole is aligned with the maximum overhang fixing hole 31. The fixing pin 34 is then inserted through the aligned holes. The leading end arm 18 is not pulled out of the intermediate arm 17. The outrigger cylinder 20 is extended to contact the ground contact portion 19 with the ground. The traveling member 6 is thus allowed to float to complete installation.

The load cells 23A, 23B, 23C, and 23D in the respective load detectors 2 detect the ground reactions Pa, Pb, Pc, and Pd to the outriggers A, B, C, and D as the load values Fa, Fb, Fc, and Fd, respectively; the load detector 2 is provided at the base end of the outrigger cylinder 20 of each of the outriggers A, B, C, and D. The load values Fa, Fb, Fc, and Fd are then sent to the alarm output section 4.

As shown in FIG. 4, the load detector 2 is provided at the base end of the outrigger cylinder 20. If the rising and lying shaft 14 of the base end of the base end arm 15 is defined as the center of a moment attributed to the ground reaction, the product of the ground reaction P acting on the ground contact portion 19 and the overhang distance La of the outrigger is equal to the product of the force F exerted on the load detector 2 and the distance Lb between the rising and lying shaft 14 and the attaching pin 21 of the outrigger cylinder 20. That is, since:

$$P \times La = F \times Lb,$$

the ratio of the force F acting on the load detector 2 to the ground reaction P is:

$$F/P = La/Lb.$$

Therefore, if the overhang distance La of the outrigger is 0.75 m and the distance Lb between the rising and lying shaft 14 and the attaching pin 21 of the outrigger cylinder 20 is 0.3 m, the value F detected by the load detector 2 is 2.5 times as large as the value for the actual ground reaction P.

The adding means 41 of the alarm output section 4 calculates the sums of values detected by the load cells 23 of every two longitudinally or laterally adjacent outriggers.

$$S1 = Fa + Fb$$

$$S2 = Fb + Fc$$

$$S3 = Fc + Fd$$

$$S4 = Fd + Fa$$

The comparing means 42 compares the sums S1, S2, S3, and S4 of the detected values with one another to find the minimum value Smin.

In FIG. 8, the boom 5 is located between the outriggers A and D. Accordingly, the sum S2 corresponds to the minimum value Smin.

Then, the minimum value Smin is compared with the preset preliminary reference value Fn. If the minimum value Smin is smaller than the preliminary reference value Fn=55,000 N, the controller 43 outputs a preliminary alarm signal.

In this case, the ground reaction Pn acting on the ground contact portion 19 is 22,000 N, two-fifths of the preliminary reference value Fn=55,000 N.

Further, when the minimum value Smin is smaller than the preset limit reference value Fu=20,000 N, the controller 43 outputs a limit alarm signal. The controller 43 also outputs a stop signal to actuate the unload valve (not shown) in the crawler crane 1 to stop the crawler crane 1.

On this occasion, the ground reaction Pn acting on the ground contact portion 19 is 8,000 N, two-fifths of the limit reference value Fu=20,000 N.

Figure 9:
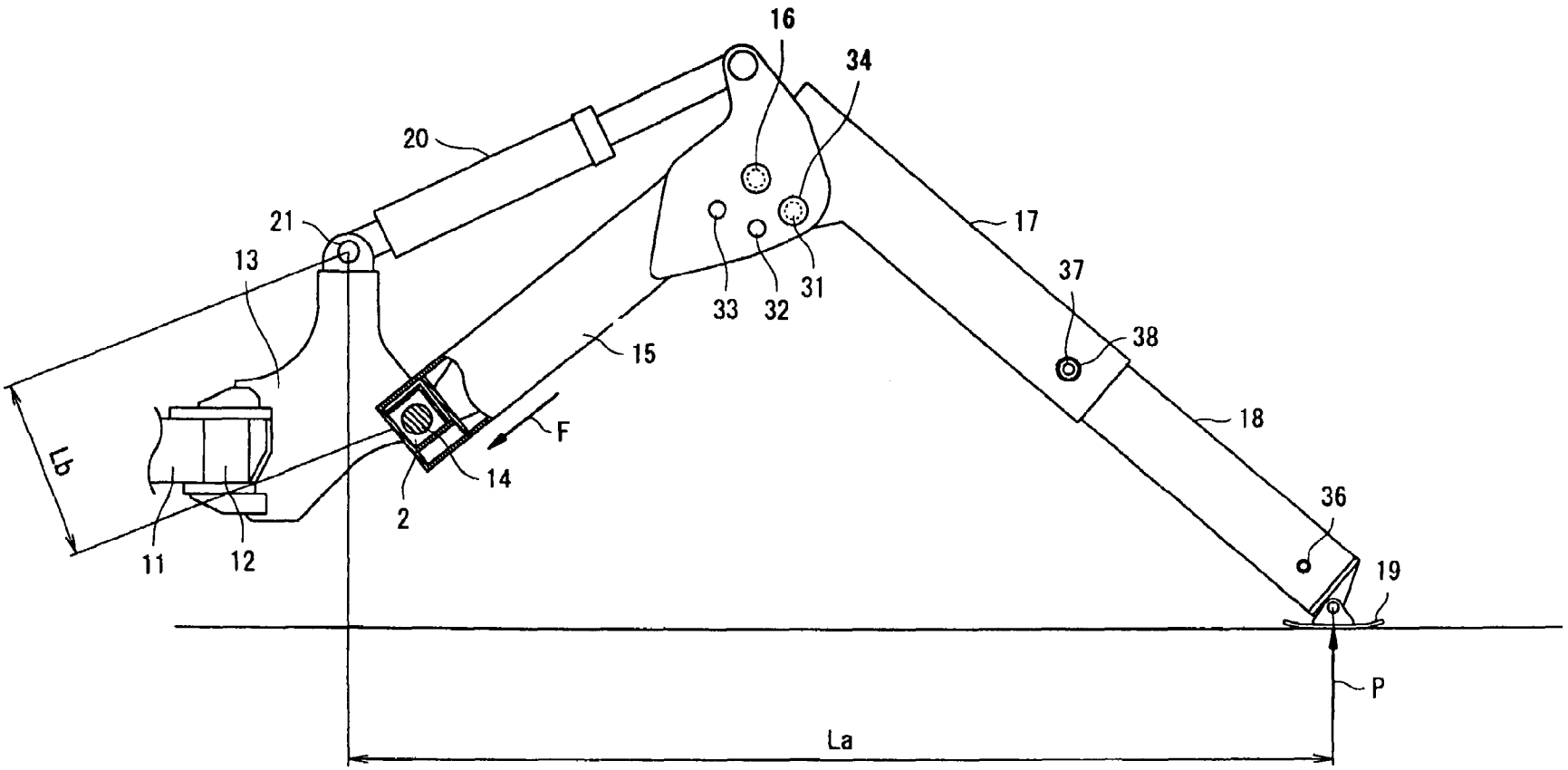
FIG. 9 is a side view of the outrigger in which the load detector is attached to a base end of a base end arm.

The load detector 2 may be provided at the base end of the base end arm 15 as shown in FIG. 9, rather than at the base end of the outrigger cylinder 20.

Figure 10:
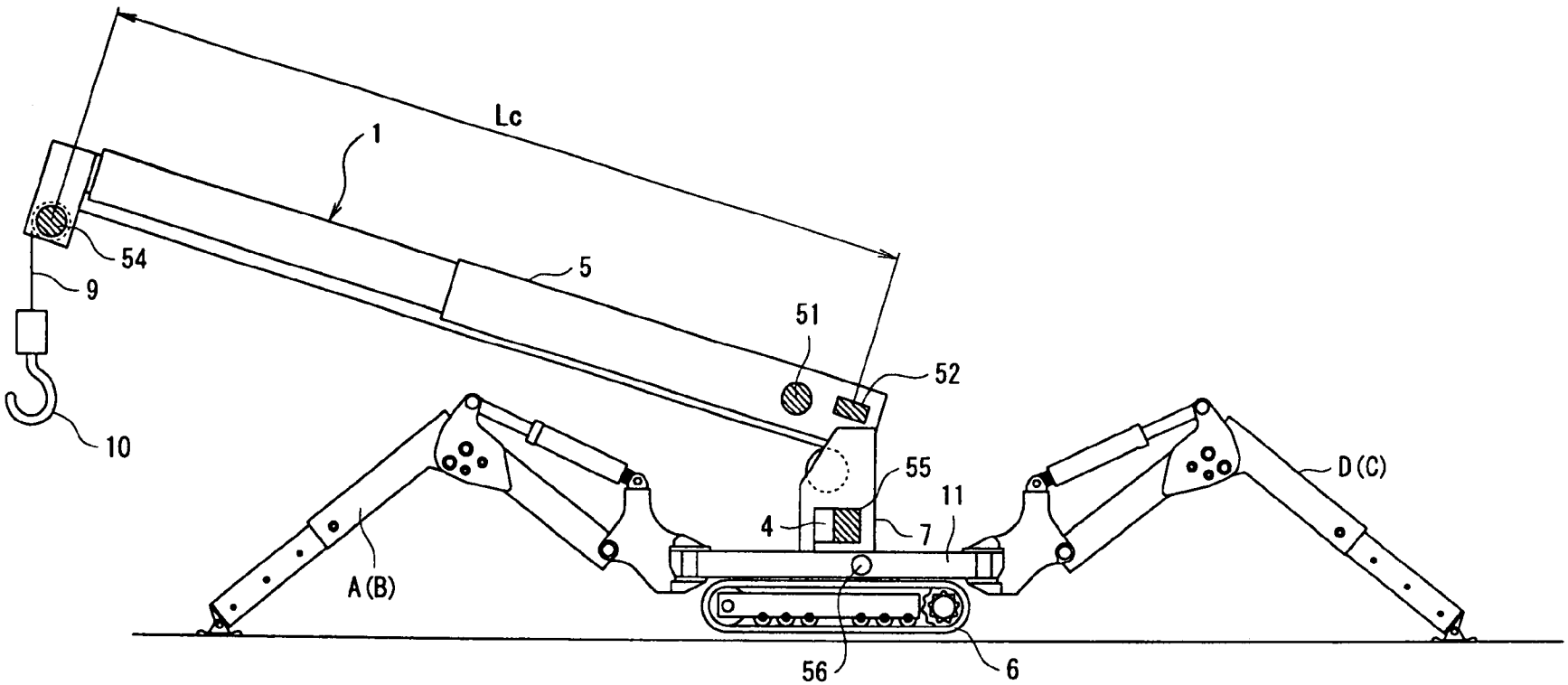
FIG. 10 is a side view of the crawler crane provided with a damage preventing device.
Figure 11:
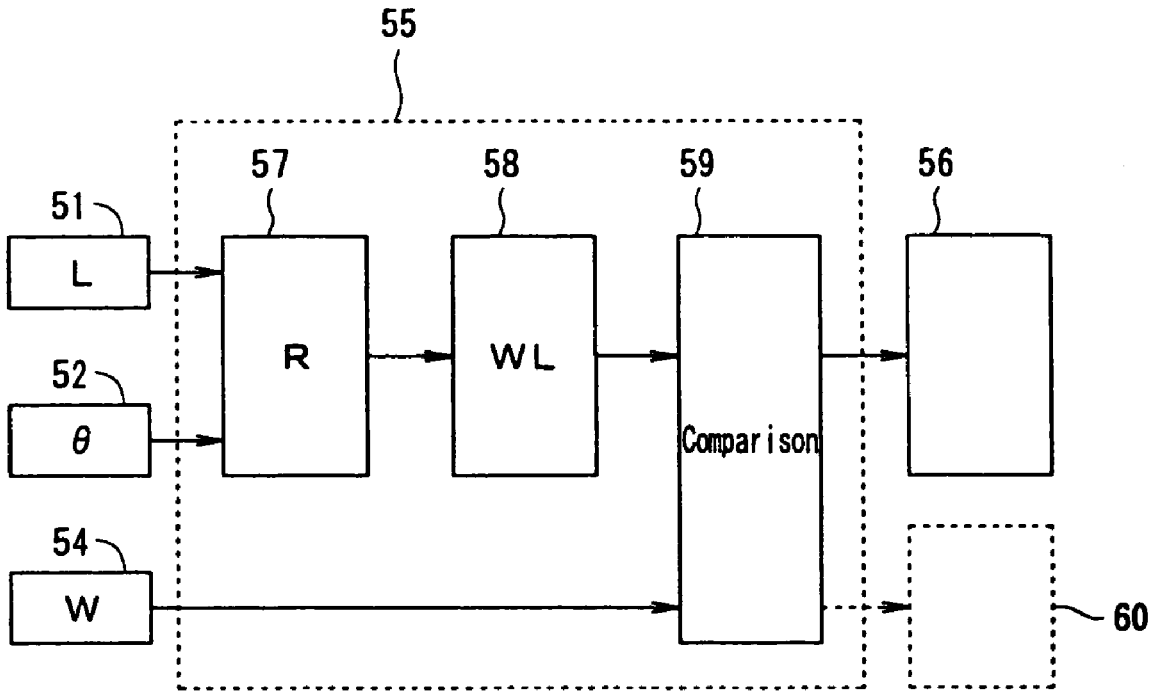
FIG. 11 is a block diagram showing the configuration of the damage preventing device.
Figure 12:
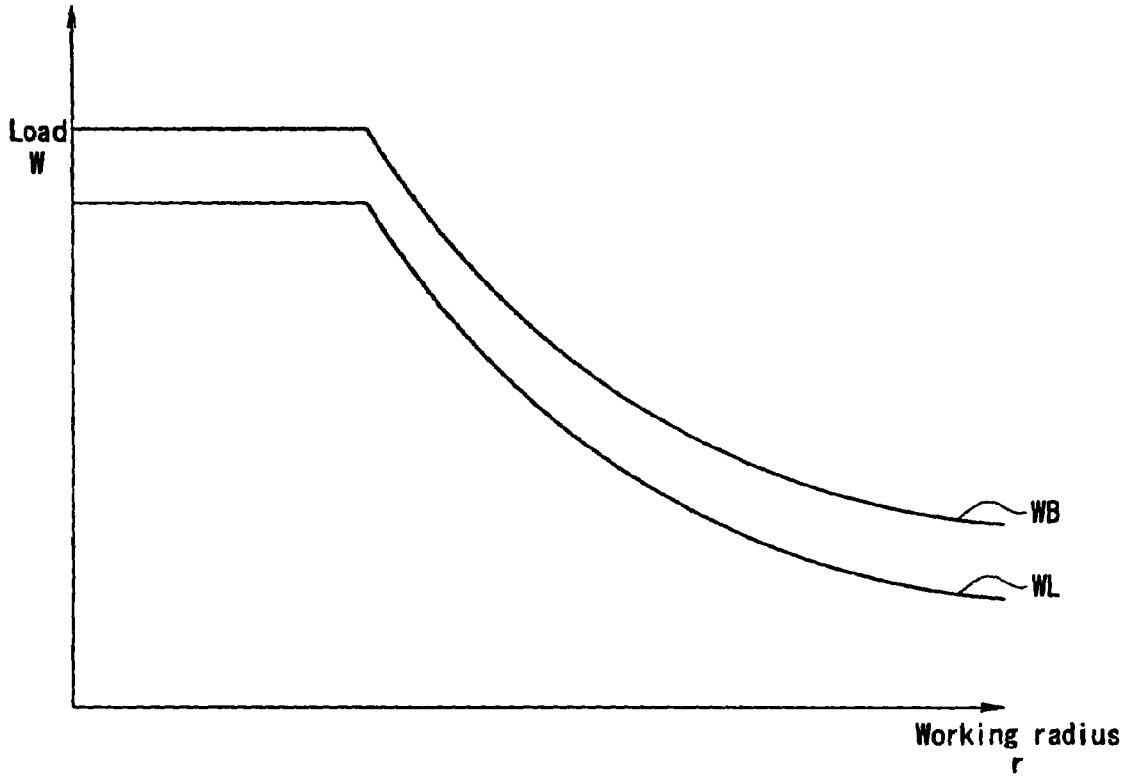
FIG. 12 is a diagram showing the relationship between a limit load and a crane strength limit load with respect to a working radius.
Figure 13:
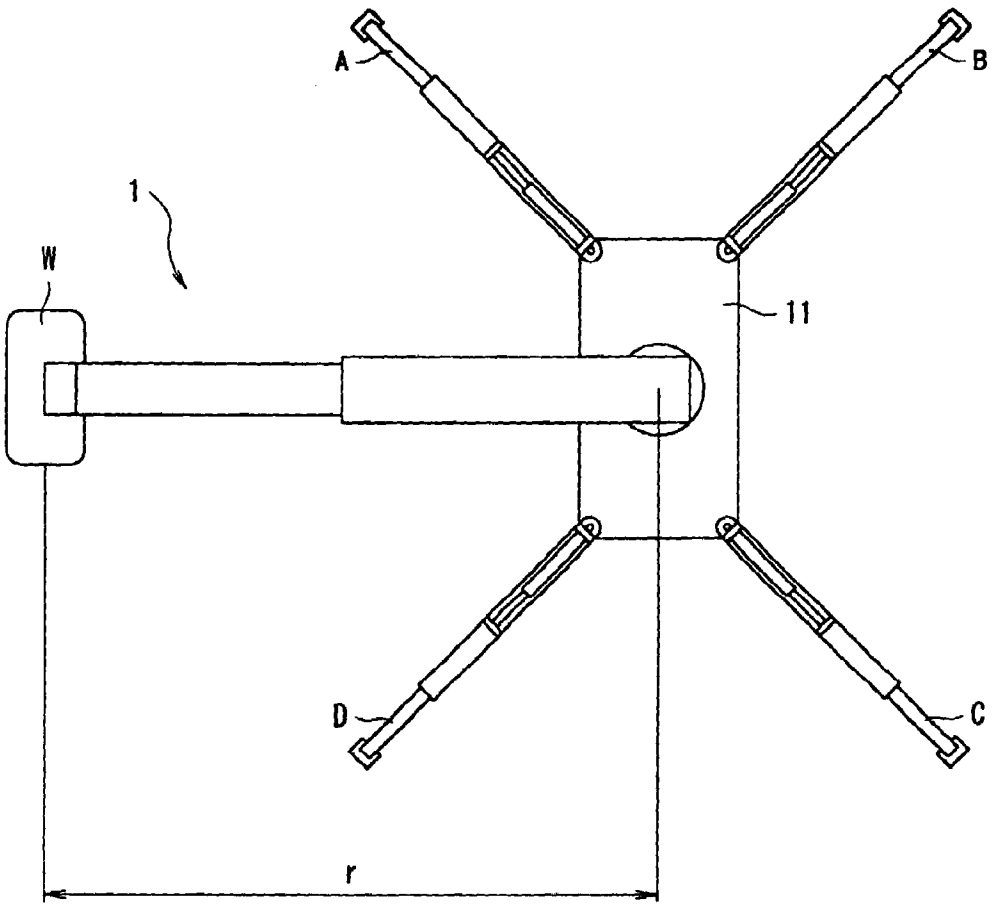
FIG. 13 is a plan view of a conventional crawler crane.
Figure 14:
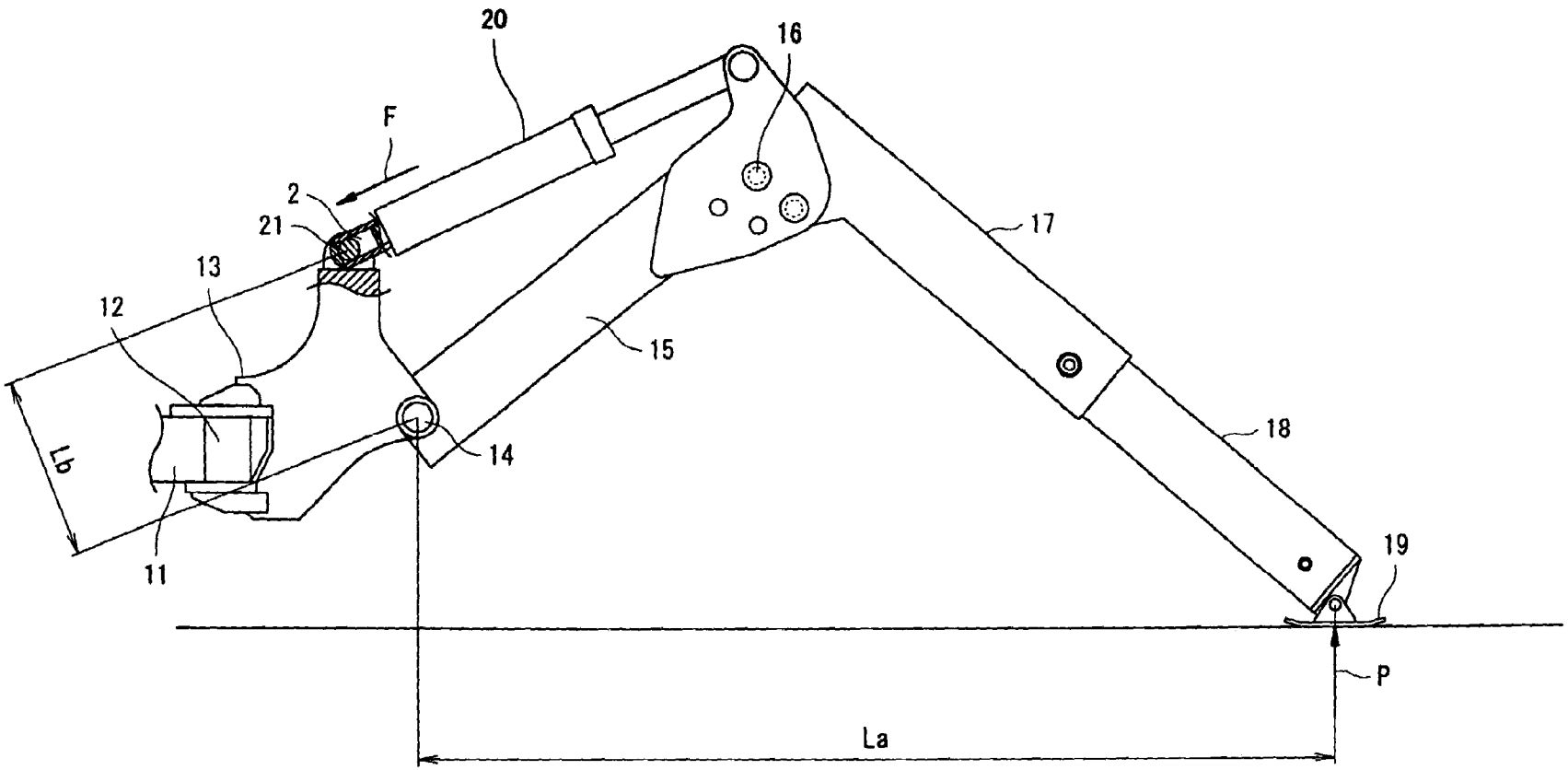
FIG. 14 is a side view of an outrigger in the conventional crawler crane.

FIG. 10 is a side view of the crawler crane provided with a damage preventing device in accordance with another embodiment of the present invention. FIG. 11 is a block diagram showing the configuration of the damage preventing device. FIG. 12 is a diagram showing the relationship between the limit load and the crane strength limit load with respect to the working radius.

The crawler crane 1 shown in FIG. 10 has the boom 5 pivotably supported by a column 7 turned on the frame 11 and which can be freely expanded and contracted and raised and laid. A hook 10 is hung from a leading end of the boom 5 using a wire rope 9 from a winch (not shown).

The crawler crane 1 comprises a safety device against crane overturning provided with a damage preventing device. That is, the boom 5 is provided with a boom length detector 51, a boom angle detector 52, and a load detector 54 that detects the lifting load by detecting the tension acting on the wire rope 9. Further, the alarm output section 4 additionally has a calculation control section 55 used to prevent damage. A crane operation stopping means 56 is provided on the frame 11.

A load cell is used as the load detector 54. However, a different system may be used which, for example, detects the lifting load on the basis of a difference in internal pressure in a rising and lying cylinder of the boom 5. Further, as described above, the sum ΣPi of the ground reactions to all the outriggers A, B, C, and D is equal to the sum of the lifting load W and the weight (fixed) of the machine body. Accordingly, the load detector 2 can be used to detect loads.

The calculation control section 55 comprises a working radius calculating section 57, a limit load calculating section 58, and a comparing section 59.

For crane operations, the boom 5 is expanded or contracted or raised or laid. A cargo is caught on the hook 10 and is lifted or lowered using the winch.

On this occasion, the boom length detector 51 detects the boom length Lc and the boom angle detector 52 detects the boom angle θ. These detected values are sent to a working radius calculating section 57. The load detector 54 detects and sends the lifting load W to a comparing section 59.

The working radius calculating section 57 determines the working radius r on the basis of the boom length Lc and the boom angle θ. The working radius calculating section 57 then sends the value of the working radius r to a limit load calculating section 58.

A limit load WL is preset in the limit load calculating section 58 in association with the working radius r; the limit load WL is used to prevent damage and is set lighter than a crane strength limit load WB that may damage the crawler crane 1 as shown in FIG. 12. The limit load calculating section 58 determines the corresponding limit load WL on the basis of the working radius r sent by the working radius calculating section 57. The limit load calculating section 58 sends the value of the limit load WL to the comparing section 59.

The comparing section 59 compares the limit load WL obtained by the limit load calculating section 58 with the lifting load W sent by the load detector 54. When the lifting load W is equal to or heavier than the limit load WL, the comparing section 59 sends a stop signal to the crane operation stopping means 56 to stop the operation of the crawler crane 1.

The crane operation stopping means 56 is, for example, a solenoid valve used to allow the unload valve in an actuating circuit in a hydraulic actuator in the crawler crane 1 to perform an unload operation.

Alarm generating means 60 may be provided instead of the crane operation stopping means 56. Then, when the lifting load W becomes equal to or heavier than the limit load WL, the comparing section 59 sends an alarm signal to call the operator's attention.

Thus, if the boom 5 is located above any of the outriggers A, B, C, and D, the operation of the crawler crane 1 is stopped or an alarm is output to call the operator's attention before the lifting load W becomes excessive and exceeds the crane strength limit load WB to damage the crawler crane 1. This makes it possible to prevent not only overturning of the crawler crane 1 but also damage to the crawler crane 1.

INDUSTRIAL APPLICABILITY OF THE INVENTION

As described above, according to the safety device against crane overturning of the present invention, a fixed outrigger overhang distance makes it possible to prevent an increase in working radius from reducing the preliminary reference value and the limit reference value. It is thus possible to prevent safety from being degraded as a result of a change in working radius.

It is unnecessary to calculate the sum of the ground reactions to all the outriggers or the ratio of the minimum value of sums of the ground reactions to every two adjacent outriggers to the sum of the ground reactions to all the outriggers. This simplifies calculating processes.

The load detector uses the coned disk spring. This serves to reduce the external size of the load detector to enable a heavy load to be detected. Consequently, no problem occurs even if the force exerted on the load detector becomes stronger than the ground reaction acting on the ground contact portion. This enables the installation position to be freely selected.

The load detector is provided at the base end of the outrigger cylinder or at the base end of the base end arm. This prevents electric wiring from being broken as a result of provision of the load detecting device at the leading end of the boom.

Moreover, the safety device against crane overturning comprises the damage preventing device including the boom length detector that detects the length of the boom, the boom angle detector that detects the angle of the boom, the load detector that detects the lifting load, and the calculation control section which determines the limit load used to prevent damage and corresponding to the working radius, on the basis of values detected by the boom length detector and boom angle detector, the calculation control section then comparing the limit load obtained with the value detected by the load detector, and outputting a damage prevention signal when the value detected by the load detector reaches the value for the limit load. Then, the safety device stops the operation of the crawler crane or outputs an alarm to call the operator's attention before the lifting load becomes excessive and equal to the crane strength limit load that may damage the crawler crane. This makes it possible to prevent the crawler crane from being damaged.

The invention claimed is:

1. A safety device against crane overturning which operates in a crawler crane comprising at least four outriggers and a frame, the four outriggers operable to make allowance for variation so as to maximize or minimize an overhang distance, an attaching member rotatively movable in a horizontal direction and supported by the frame, a base end arm supported by the attaching member so that the base end arm can be freely raised and laid, an intermediate arm supported by the base end are so that the intermediate arm can be freely raised and laid, a leading end arm in slidable contact with the intermediate arm, an outrigger cylinder provided between the attaching member and the base end arm and operable to raise and lay the base end arm; the safety device comprising:

a load detector that detects a ground reaction to each of the outriggers; and an alarm output section operable to calculate sums of detected values for ground reactions to every two adjacent outriggers to find a minimum value of the sums, to compare the minimum value with a preliminary reference value that represents a preliminary alarm state prior to the crane reaching a stability limitation and a limit reference value that represents a need to stop the crane so that the crane reaches the stability limitation in its maximum overhang state or in its minimum overhang state, and to output a preliminary alarm signal when the minimum value is smaller than the preliminary reference value or output a limit alarm signal when the minimum value is smaller than the limit reference value.

2. The safety device against crane overturning according to claim 1, characterized in that the load detector is provided with a coned disk spring which serves as an elastic member supporting a load.

3. The safety device according to claim 2 wherein the load detector is provided at a base end of the outrigger cylinder or at a base end of the base end arm.

4. The safety device according to claim 2, further comprising:

setting switching means for enabling switching of the preliminary reference value and the limit reference value to be switched and set in accordance with an overhang distance of each outrigger.

5. The safety device according to claim 2, further comprising:

operation switching means for switching the safety device between an inoperative mode and an operative mode depending on whether the crawler crane is in a traveling mode or in a crane mode.

6. The safety device according to claim 2, further comprising:

a damage preventing device including:

a boom length detector that detects a length of a boom;

a boom angle detector that detects an angle of the boom;

a load detector that detects a lifting load; and a calculation control section operable to determine a limit load used to prevent damage and corresponding to a working radius calculated based on the length and the angle, to compare the limit load with the lifting load, and to output a damage prevention signal when the lifting load reaches the limit load.

7. The safety device against crane overturning according to claim 1, characterized in that the load detector is provided at a base end of the outrigger cylinder.

8. The safety device against crane overturning according to claim 1, characterized in that the load detector is provided at a base end of the base end arm.

9. The safety device against crane overturning according to claim 1, further comprising:

setting switching means for enabling the preliminary reference value and the limit reference value to be switched and set in accordance with an overhang distance of each outrigger.

10. The safety device against crane overturning according to claim 1, further comprising:

operation switching means for switching the safety device between an inoperative mode and an operative mode depending on whether the crawler crane is in a traveling mode or in a crane mode.

11. The safety device against crane overturning according to claim 1, further comprising:

a damage preventing device including a boom length detector that detects a length of a boom, a boom angle detector that detects an angle of the boom, a load detector that detects a lifting load, and a calculation control section operable to determine a limit load used to prevent damage and corresponding to a working radius based on values detected by the boom length detector and boom angle detector, to compare the limit load with the lifting load detected by the load detector, and to output a damage prevention signal when the lifting load detected by the load detector reaches the limit load.

12. The safety device according to claim 1 wherein the load detector is provided at the base end of the outrigger cylinder or the base end of the base end arm; and wherein the load detector comprises:

a load cell in an upper cell case; and a plurality of coned disk springs provided between a spring pressure of a shaft and a lower cell case, an elasticity of the coned disk springs holding the upper cell case and lower cell case so as to form a gap between the cell cases; and wherein the coned disk springs are arranged to flex when a load is imposed on the lower cell case, causing the load cell to output a load detection signal, and the upper cell case joins to the lower cell case to protect the load cell from overload when the load exceeds a set load.

13. The safety device according to claim 12, further comprising:

a damage preventing device including:

a boom length detector that detects a length of a boom;

a boom angle detector that detects an angle of the boom;

a load detector that detects a lifting load; and a calculation control section operable to determine a limit load used to prevent damage and corresponding to a working radius calculated based on values detected by the boom length detector and boom angle detector, to compare the limit load with the lifting load detected by the load detector, and to output a damage prevention signal when the lifting load detected by the load detector reaches the limit load.

14. The safety device according to claim 12, further comprising:

setting switching means for enabling the preliminary reference value and the limit reference value to be switched and set in accordance with an overhang distance of each outrigger.

15. The safety device according to claim 12, further comprising:

operation switching means for switching the safety device between an inoperative mode and an operative mode depending on whether the crawler crane is in a traveling mode or in a crane mode.

* * * * *

UNITED STATES PATENT AND TRADEMARK OFFICE

CERTIFICATE OF CORRECTION

PATENT NO. : 7,364,044 B2
APPLICATION NO. : 10/552787
DATED : April 29, 2008
INVENTOR(S) : Shigemoto Hinata et al.

It is certified that error appears in the above-identified patent and that said Letters Patent is hereby corrected as shown below:

Column 6, Line 34; After “6” insert -- , --.

Column 6, Line 64; Delete “The” and insert -- the --, therefor.

Column 7, Line 25; (Approx.); Delete “111” and insert -- 11 --, therefor.

Column 7, Line 66; Delete “in,” and insert -- m --, therefor.

Signed and Sealed this

Twenty-ninth Day of July, 2008

JON W. DUDAS
*Director of the United States Patent and Trademark Office*